US006132261A

United States Patent [19]

Lee et al.

[11] Patent Number: 6,132,261

[45] Date of Patent: Oct. 17, 2000

[54] HIGH-DENSITY ELECTRICAL CONNECTOR

[75] Inventors: Ming-Wu Lee; Kun-Tsan Wu, both of Tu-Chen; Song-Rong Chiou, Lin-Kou, all of Taiwan

[73] Assignee: Hon Hai Precision Ind. Co., Ltd., Taipei Hsien, Taiwan

[21] Appl. No.: 09/407,631

[22] Filed: Sep. 28, 1999

[30] Foreign Application Priority Data

Dec. 24, 1998 [TW] Taiwan ..... 87121639

[51] Int. Cl.[7] ..... H01R 13/405

[52] U.S. Cl. ..... 439/736

[58] Field of Search ..... 439/736, 701, 439/885, 660

[56] References Cited

U.S. PATENT DOCUMENTS 4,690,479 9/1987 Hollyday ..... 439/97
5,057,027 10/1991 Yamada ..... 439/83
5,637,014 6/1997 Sukegawa ..... 439/607
5,697,799 12/1997 Consoli ..... 439/181
5,964,594 10/1999 Saitoh ..... 439/74

*Primary Examiner*—Paula Bradley
*Assistant Examiner*—Phuong Chi Nguyen
*Attorney, Agent, or Firm*—Wei Te Chung

[57] ABSTRACT

A high-density electrical connector comprises two sets of SMT contacts and two sets of DIP contacts, a dielectric housing formed by insert molding and a shield covering the housing, the dielectric housing comprises a pair of first housing members and a second housing member around the pair of first housing members, each first housing member is insert molded to a set of SMT contacts on one side thereof and a set of DIP contacts on an opposite side thereof in a first insert molding step, the second housing member is insert molded to and combines the pair of first housing members having the SMT contacts and the DIP contacts, thus, proper alignment, engagement, and coplanarity of the contacts assembled in the housing are easily obtained without interference from an insertion force.

1 Claim, 7 Drawing Sheets

HIGH-DENSITY ELECTRICAL CONNECTOR

BACKGROUND OF THE INVENTION

The present invention relates to a high-density electrical connector and a manufacturing method to make the same.

As computer technology advances, high-density portable electronic devices are becoming increasingly popular. Connectors of such electronic devices generally have a large number of conductive contacts densely aligned in a dielectric housing thereof. Such high-density connectors must be designed to fulfill requirements of proper alignment, engagement and coplanarity of the contacts assembled in the housing. Contacts of conventional connectors are usually inserted into manufactured housings. However, achieving reliability of all the contacts assembled in the housing is difficult because the contacts often change shape during insertion. In addition, insertion of contacts into the housing may damage the housing because walls thereof are very thin for achieving a high-density arrangement of the contacts. Furthermore, the contacts of the conventional connector are soldered to a circuit board by means of either SMT or DIP, but arranging high-density printed circuit pads or drilling holes on the circuit board is complicated. Hence, an improved electrical connector is required to overcome the disadvantages of the prior art.

BRIEF SUMMARY OF THE INVENTION

A first object of the present invention is to provide a high-density electrical connector having contacts properly assembled in a housing thereof.

A second object of the present invention is to provide a method of manufacturing a high-density electrical connector whereby the contacts of the connector are retained in the housing by insert molding.

A third object of the present invention is to provide a method of manufacturing connectors at a low cost and high efficiency.

Accordingly, a high-density electrical connector in accordance with the present invention comprises a plurality of SMT and DIP contacts each having a mating portion and a mounting portion, an insert molded dielectric housing formed to retain the contacts therein and a shield covering a mating face of the housing. A manufacturing method of the high-density electrical connector comprises steps of:

a. Manufacturing and positioning SMT and DIP contact carriers:

An SMT contact carrier comprises a plurality of SMT contacts which are stamped and formed from sheets of metal and a first carrier plate joining the SMT contacts together. A DIP contact carrier comprises a plurality of DIP contacts which are stamped and formed from sheets of metal and a second carrier plate joining the DIP contacts together. The SMT and DIP contact carriers are positioned such that a first plane that mating portions of the SMT contacts lie in is abreast distanced to a second plane that mating portions of the DIP contacts lie in. Free ends of the mating portions of the SMT and DIP contacts are positioned at a same level.

b. First insert molding:

The positioned SMT and DIP contact carriers are placed in a first module and melting dielectric material is injected into the first module. When cooled, the melting dielectric material solidifies to form a base and a crossbeam distanced from the base thereby constituting a first housing member of the housing for retaining the SMT and DIP contact carriers therein.

c. Severing the second carrier plates from the DIP contact carriers:

The second carrier plates are cut off from the DIP contact carries at predetermined positions, and tails of the DIP contacts are trimmed for facilitating insertion of mounting portions thereof into a circuit board.

d. Second insert molding:

A pair of first housing members formed in the step "b" is abreast positioned in a second module with the two SMT contact carries distanced from each other. The same kind of melting dielectric material used as in step "b" is injected into the second module to form a second housing member combining the two first housing members to form the housing.

e. Severing the first carrier plates from the SMT contact carriers:

The first carrier plates are severed from the SMT contact carriers at predetermined positions.

f. Assembling the shield to the housing:

The shield is assembled to a mating face of the housing. A pair of nuts is upwardly inserted through the housing and the shield with heads thereof extending beyond the shield. The heads are riveted to the shield to join the shield and the housing together.

Other objects, advantages and novel features of the invention will become more apparent from the following detailed description of the present embodiment when taken in conjunction with the accompanying drawings.

DETAILED DESCRIPTION OF THE INVENTION

Figure 8:
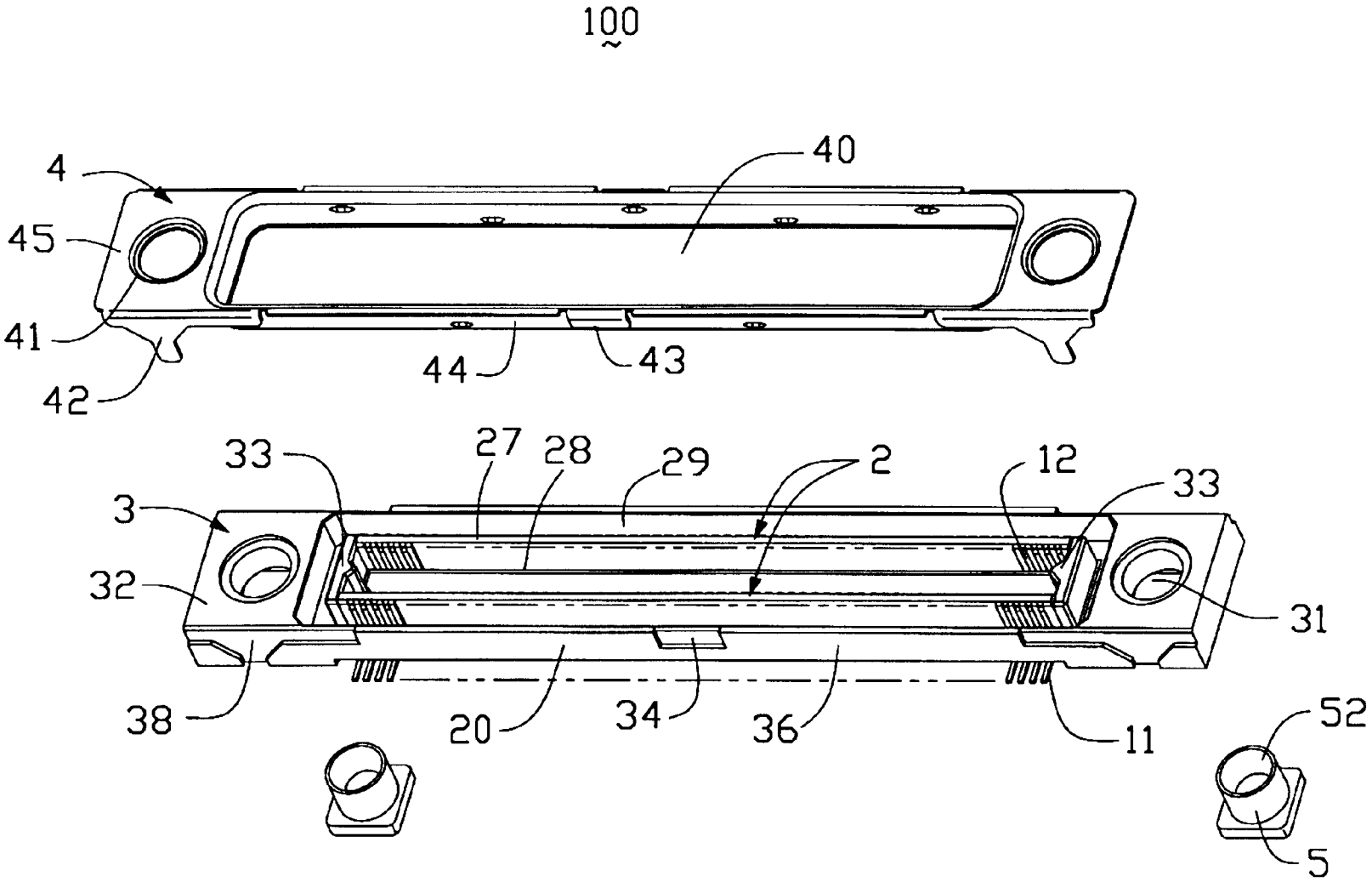
FIG. 8 is an exploded view of the high-density electrical connector assembly.
Figure 9:
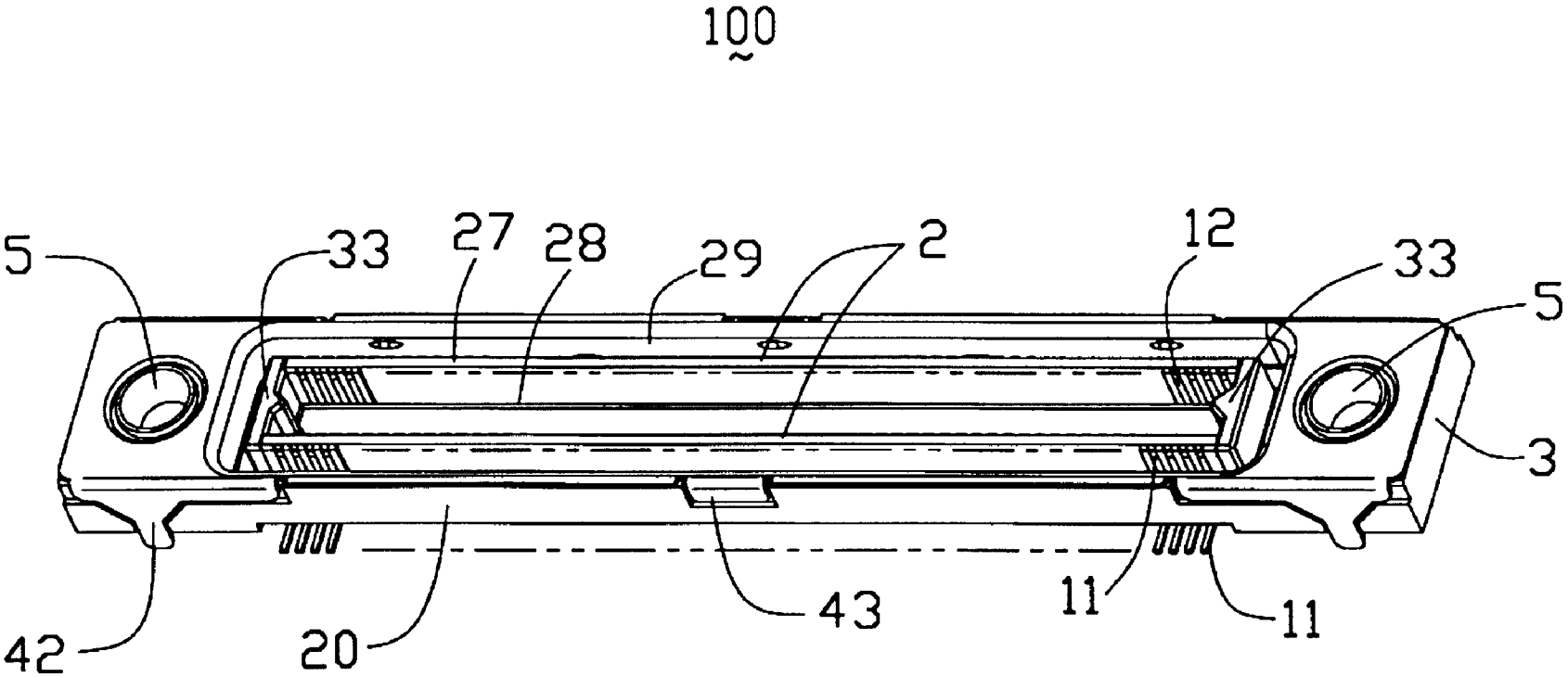
FIG. 9 is an assembled view of FIG. 8.

Referring to FIGS. 8 and 9, a high-density electrical connector 100 of the present invention comprises a dielectric housing 3, two sets of SMT contacts 11 and two sets of DIP contacts 12, a shield 4 mounting on the housing 3, and a pair of nuts 5 joining the housing 3 and the shield 4 together. The housing 3 comprises a pair of elongate first housing members 2 and a second housing member 20 around the first housing members 2. The SMT contacts 11 and the DIP contacts 12 are respectively retained in opposite sides of the first housing members 2. The shield 4 is stamped and formed from sheet of metal and comprises a pair of parallel beams 44 and a pair of aprons 45 connecting opposite free ends of the beams 44. A slot 40 is defined between the beams 44 and the aprons 45. Each apron 45 defines a cutout 41 in a middle portion thereof, and a pair of feet 42 downwardly extending from each apron 45 for being soldered to a circuit board (not shown). A tongue 43 downwardly extends from a middle portion of each beam 44 for securing the shield 4 to the housing 3.

Figure 1:
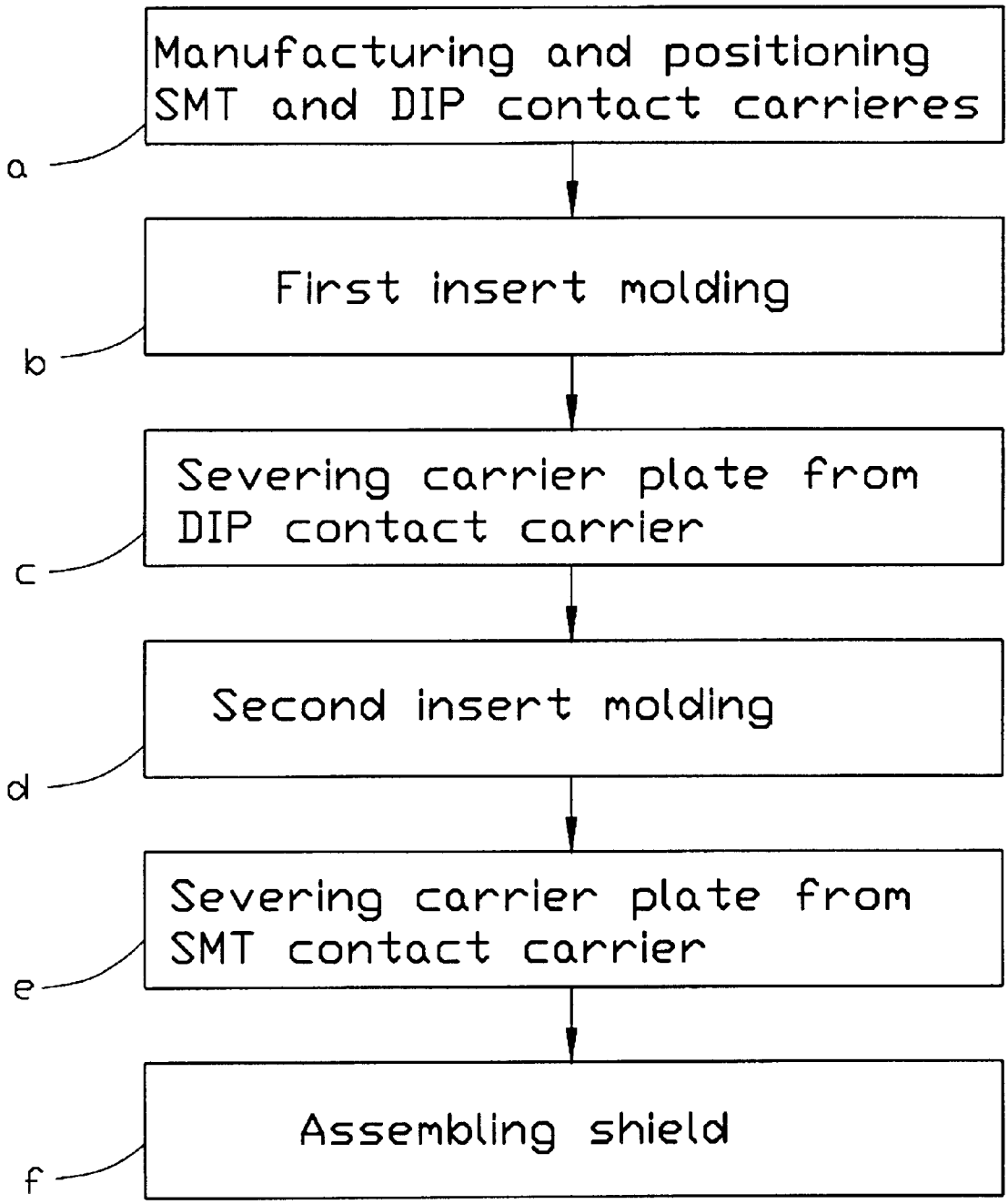
FIG. 1 is a flow chart illustrating manufacturing processes of a high-density electrical connector in accordance with the present invention.
Figure 2:
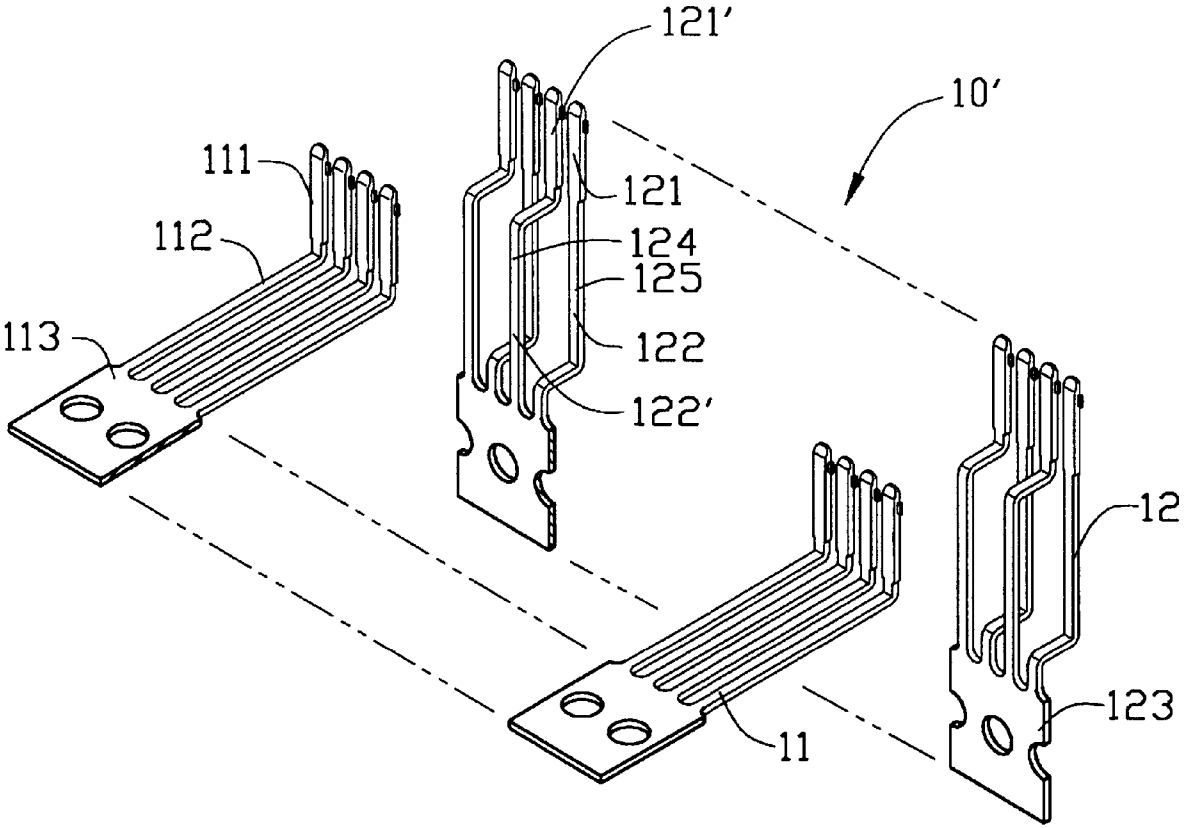
FIG. 2 is a perspective view of a DIP contact carrier and an SMT contact carrier of the high-density electrical connector.
Figure 4:
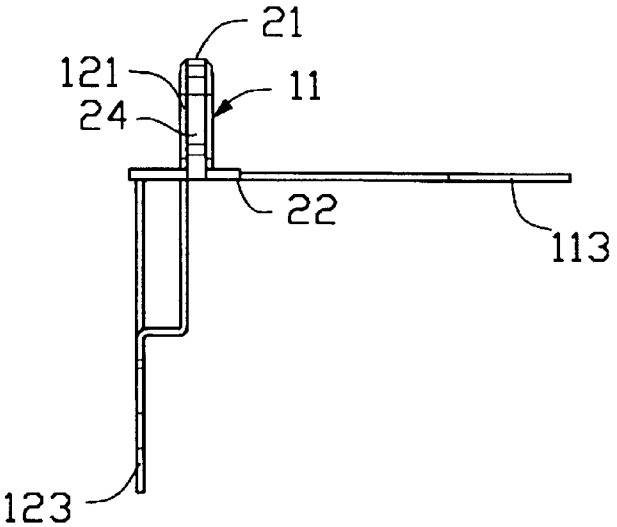
FIG. 4 is side view of FIG. 3.
Figure 3:
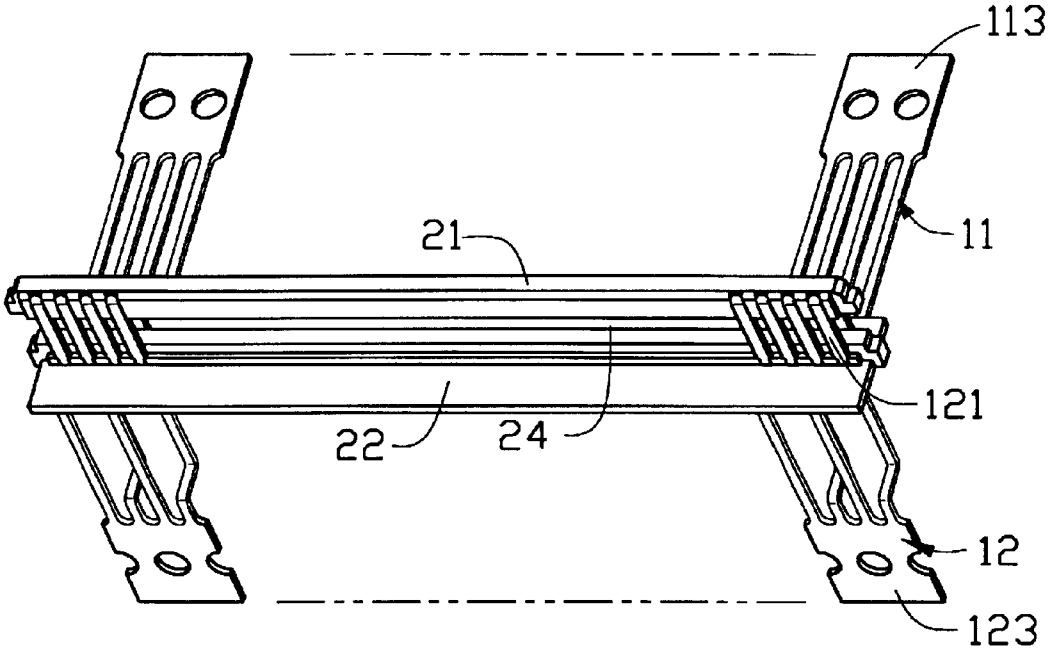
FIG. 3 is a perspective view of a first housing member of the housing insert molded to the DIP contact carrier and the SMT contact carrier.
Figure 6:
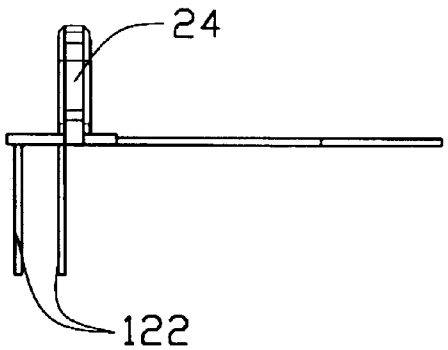
FIG. 6 is a side view of FIG. 5.
Figure 5:
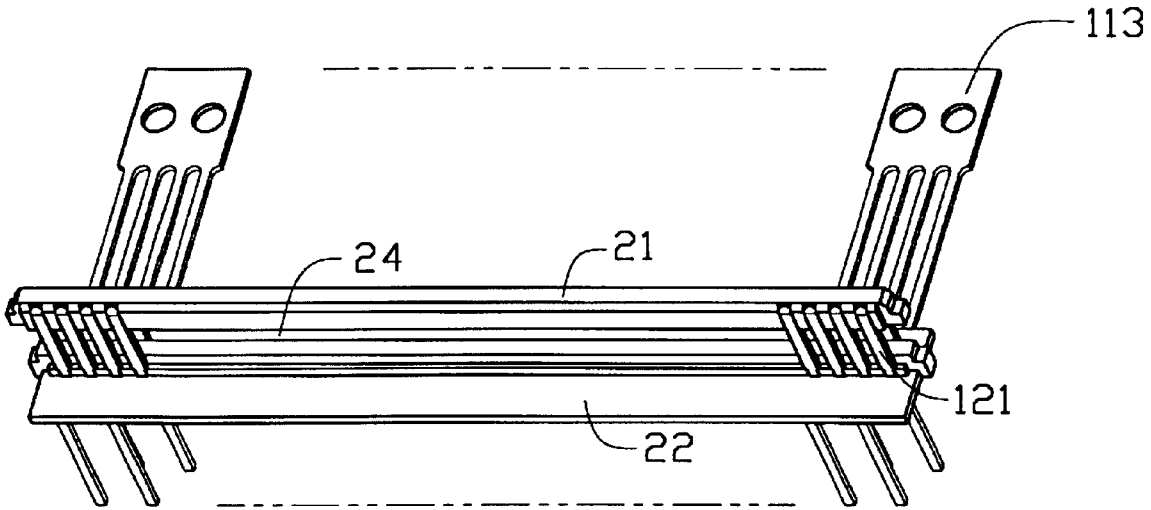
FIG. 5 is similar to FIG. 3 but a carrier plate is severed from the DIP contact carrier.
Figure 7:
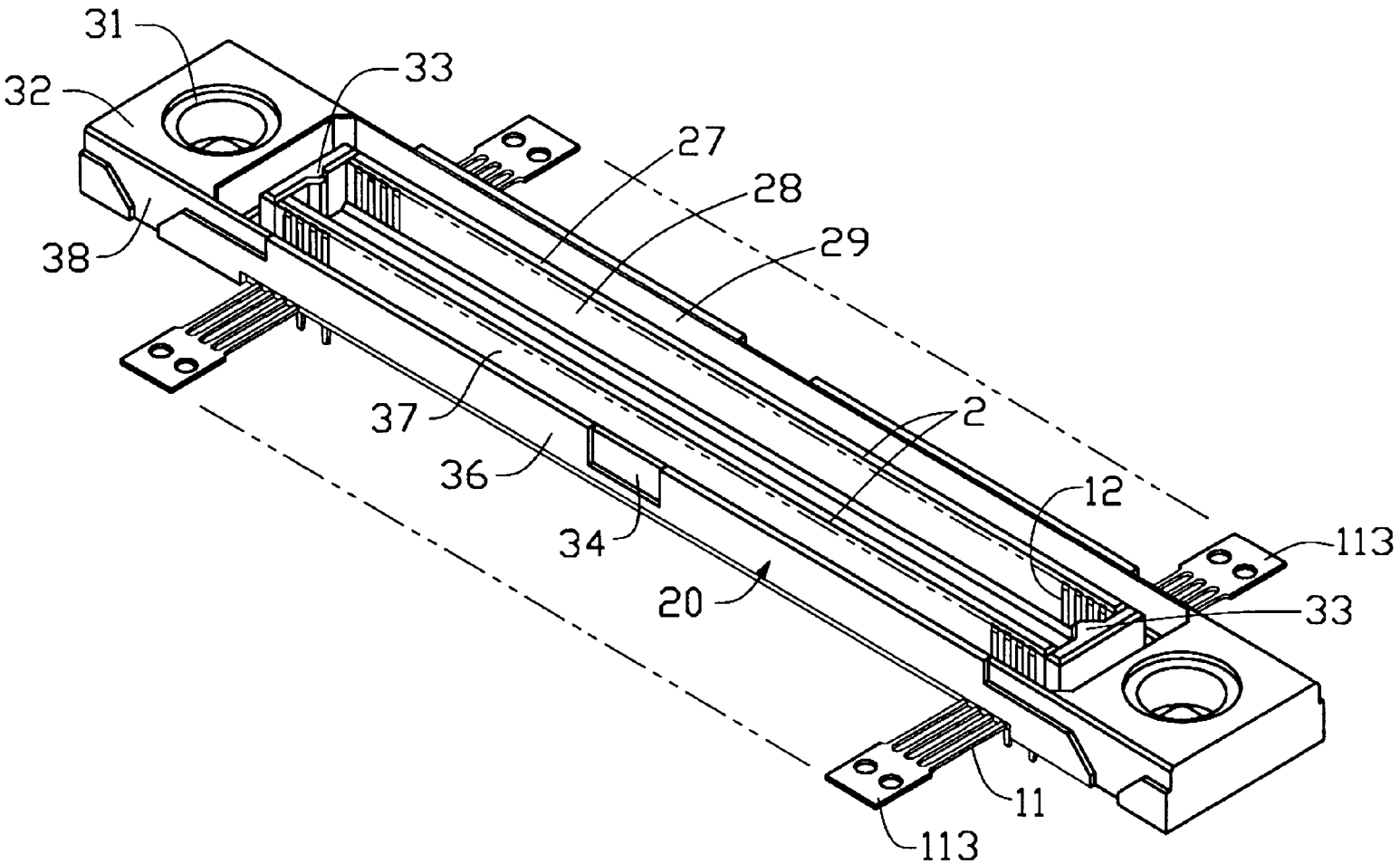
FIG. 7 is a perspective view of the high-density electrical connector after a second insert molding procedure.

Referring to FIG. 1, a method of manufacturing the high-density electrical connector 100 of the present invention comprises steps of:

a. Manufacturing and positioning SMT and DIP contact carriers:

Also referring to FIG. 2, metal sheets are respectively stamped to form an SMT contact carrier 10 and a DIP contact carrier 10'. The SMT contact carrier 10 comprises a set of SMT contacts 11 and a first carrier plate 113 joining the SMT contacts 11 together and the DIP contact carrier 10' comprises a set of DIP contacts 12 and a second carrier plate 123 joining the DIP contacts 12 together. Each SMT contact 11 is perpendicularly bent at a predetermined position to form a mounting portion 112 for mounted to a circuit board (not shown) and a mating portion 111 for mating with a mated connector (not shown). Each DIP contact 12 comprises a mating portion 121 (121') and a mounting portion 122 (122') for insertion into a hole of the circuit board. The set of DIP contacts 12 comprises a group of first DIP contacts 125 each bent twice proximate the mounting portion 122 thereof and a group of second DIP contacts 124 each bent twice proximate the mating portion 121' thereof. The SMT and DIP contact carriers 10, 10' are positioned such that a first plane in which the mating portions 111 of the SMT contacts 11 lie is abreast distanced to a second plane in which the mating portions 121 (121') of the DIP contacts 12 lie. Free ends of the mating portions 111, 121 (121') of the SMT and DIP contacts 11, 12 are positioned at a same level. The mating portions 111, 121 (121') are distanced a pitch of 0.8 millimeter from each other.

b. First insert molding:

Referring to FIGS. 3 and 4, the positioned SMT and DIP contact carriers 10, 10' are set in a first module (not shown) and melting dielectric material is injected into the first module. When cooled, the melting dielectric material solidifies to form a first housing member 2 comprising a base 22 and a crossbeam 21 distanced from each other. The crossbeam 21 and the base 22 respectively retain the mating portions 111, 121 (121') and the mounting portions 112, 122 (122') of the contacts 11, 12 in opposite sides thereof. The mounting portion 122' of each second DIP contact 124 is inwardly offset a predetermined distance from the mating portion 121' of the same contact 124 in a direction transverse to the length of the first housing member 2. The offset mounting position 122' of the second DIP contact 124 lie in a plane parallel to but offset from a plane containing the non-offset mounting portions 122 of the DIP contacts 12. Thus, the proximate mounting portions 122 and 122' are distanced a pitch of 1.6 millimeter from each other. A space 24 is formed between the base 22 and the crossbeam 21 during the first insert molding procedure to facilitate a second insert molding (described in detail hereinafter).

c. Severing the second carrier plates from the DIP contact carriers:

Referring to FIGS. 5 and 6, the second carrier plate 123 is severed from the DIP contact carrier 10', and mounting tails of the DIP contacts 12 are trimmed to facilitate insertion of the mounting portions 122 (122') into a circuit board (not shown).

d. Second insert molding:

Referring to FIG. 7, a pair of first housing members 2 formed in the step "b" is abreast positioned in a second module with two rows of SMT contacts 11 distanced from each other. The two first housing members 2 are distanced from each other for engaging with the mated connector. The same kind of melting dielectric material as used in the step "b" is injected into the second module to form a second housing member 20 combining the two first housing members 2. The space 24 formed in the step "b" is filled with the melting dielectric material to further retain the contacts 11, 12 in the housing 3. The second housing member 20 comprises a pair of parallel side portions 36, a pair of stations 32 combined with distal ends of the side portions 36, and a recess portion 37 defined between the stations 32 and the side portions 36. Each station 32 defines a through hole 31 in a middle portion thereof. The second housing member 20 respectively defines a recess 34 and a pair of notches 38 in a middle portion and opposite ends of an elongate side thereof. The second housing member 20 further comprises a pair of risers 33 combining distal ends of the first housing members 2 to form a closed peripheral fence 27 (see FIGS. 7–9). The closed peripheral fence 27 defines a chamber 28 therein and a channel 29 therearound for fixedly engaging with a mating electrical connector (not shown). The two sets of SMT contacts 11 and the two sets of DIP contacts 12 are respectively located on two opposite outer surfaces and two opposite inner surfaces of the closed peripheral fence.

e. Severing the first carrier plates from the SMT contact carriers:

The first carrier plates 113 are severed from the SMT contact carriers 10.

f. Assembling the shield to the housing:

Referring to FIGS. 8 and 9, the shield 4 is assembled to the housing 3 with the cutouts 41 thereof being coaxial with the through holes 31 of the housing 3. The feet 42 are received in the corresponding notches 38 and the tongues 43 are received in the corresponding recesses 34. Each nut 5 is inserted into the through hole 31 of the housing 3 and the cutout 41 of the shield 4 with a head 52 thereof extending beyond the apron 45. Furthermore, the heads 52 are hit by a tool to rivet the shield 4 to the housing 3.

It can be readily seen that during retained in the housing 3, the SMT and DIP contacts 11, 12 do not suffer an insertion force, thus the shape of the SMT and DIP contacts 11, 12 will not change. Therefore, proper alignment, engagement and coplanarity of the contacts assembled in the housing 3 can be easily obtained. Conventional steps such as pre-insertion and pressing the contacts 11, 12 into the housing 3 are excluded thereby simplifying the manufacturing procedure. In addition, the contacts 11, 12 are compactly aligned in four rows whereby one half of them are SMT contacts 1 the other half of them are TIP contacts 12. Thus, the connector 100 is suitable for soldering to a limited space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high-density electrical connector comprising:

a plurality of contacts consisting of two sets of SMT contacts and two sets of DIP contacts, each contact having a mating portion and a mounting portion; and a dielectric housing comprising a pair of insert molded first housing members and an insert molded second housing member around the pair of first housing members and forming a pair of risers joining distal ends of the pair of first housing members, respectively, to form a closed peripheral fence therewith, said peripheral fence being insert molded to said two sets of SMT contacts in two opposite outer surfaces thereof and to said two sets of DIP contacts in two opposite inner surfaces thereof and further defining a chamber between the two opposite inner surfaces and a channel around the peripheral fence such that the SMT and DIP contacts are arranged in a very high density;

wherein each set of DIP contacts comprises a first group of DIP contacts and a second group of DIP contacts alternately arranged along one surface of each of said pair of first housing members in a lengthwise direction thereof, the mounting portions of the first group of DIP contacts being offset a predetermined distance from the mounting portions of the second group of DIP contacts in a direction perpendicular to the lengthwise direction of said first housing member;

wherein the proximate mounting portions of the SMT contacts are distanced a first pitch from each other in the lengthwise direction of said first housing member while the proximate mounting portions of the DIP contacts are distanced a second pitch from each other in the same direction which is double the first pitch;

wherein a shield mounted on a mating face of the second housing member.

* * * * *